United States Patent [19]

Kawasaki et al.

[11] Patent Number: 4,953,368

[45] Date of Patent: Sep. 4, 1990

[54] METHOD OF AND APPARATUS FOR HEAT-TREATING BOBBINS OF YARN

[75] Inventors: Takuya Kawasaki, Takarazuka; Osamu Kawakami, Amagasaki, both of Japan

[73] Assignee: Nikku Industry Co., Ltd., Itami, Japan

[21] Appl. No.: 156,789

[22] Filed: Feb. 17, 1988

[30] Foreign Application Priority Data

May 1, 1987 [JP] Japan ..... 62-106360
Jul. 17, 1987 [JP] Japan ..... 62-177162

[51] Int. Cl.[5] ..... D06B 3/09

[52] U.S. Cl. ..... 18/5 C; 68/5 D; 68/11; 57/281; 57/276; 28/285; 242/35.5 A

[58] Field of Search ..... 68/5 C, 5 D, 8, 9, 10, 68/11; 242/35.5 A, 35.5 R; 57/281, 276; 28/285, 280

[56] References Cited

U.S. PATENT DOCUMENTS 318,205 5/1885 Rau ..... 68/5 C
441,946 12/1890 Drown ..... 68/8
488,787 12/1892 Clay ..... 68/8
2,792,702 5/1957 Newcomb et al. ..... 68/189
3,331,224 7/1967 Alberto et al. ..... 68/8
3,344,622 10/1967 Kronsbein ..... 68/189
3,357,212 12/1967 Schiffner ..... 68/8
3,564,829 2/1971 Tsuzuki ..... 68/50 X
3,596,481 8/1971 Wilcox ..... 68/198 X
4,075,875 2/1978 Heidan ..... 68/5 D
4,369,035 1/1983 Karrer et al. ..... 8/155 X
4,660,368 4/1987 Kupper ..... 57/276 X

FOREIGN PATENT DOCUMENTS 893662 4/1962 United Kingdom ..... 68/5 C

*Primary Examiner*—Frankie L. Stinson
*Attorney, Agent, or Firm*—Armstrong, Nikaido, Marmelstein, Kubovcik & Murray

[57] ABSTRACT

Installed on a conveyor line which connects a spinning machine and a winding machine together, a heat treatment apparatus for bobbins of yarn which accepts a batch of upright bobbins arranged in rows and which performs steam heat treatments on the bobbins contained therein.

7 Claims, 4 Drawing Sheets

METHOD OF AND APPARATUS FOR HEAT-TREATING BOBBINS OF YARN

BACKGROUND OF THE INVENTION

The present invention relates to a method of and apparatus for heat-treating or performing steam-setting operation on the bobbins of yarn produced by a spinning machine as the bobbins are transferred from the spinning machine to a winding machine.

In the spinning process, sliver of raw cotton, wool and synthetic fiber is spun into yarn which is wound on bobbins. The finished yarn on the bobbins is then wound by the winding machine into a so-called corn cheese or parallel cheese. When a new bobbin is supplied to the winding machine, the ends of yarn should be joined.

If, however, the spun yarn is not heat-treated or steam-set, the twisting torque of the yarn that was applied during the spinning process interferes with the yarn end jointing process. That is, in the automatic yarn jointing device, the yarn end does not become aligned in the direction of the carrier air flow due to the twisting torque, resulting in a failure of the yarn end jointing.

For this reason, the bobbin of finished yarn is steam-set before being fed to the winding machine to remove the twisting torque.

Conventionally, the bobbins are randomly thrown into a bobbin case and several tens of these bobbin cases are loaded into an oven where they are subjected to a heat treatment or steam-setting operation.

The steam-setting procedure consists of collecting into the bobbin case a specified number of finished yarn bobbins produced by spinning machines, transporting the bobbins to the oven installed in a room separate from the spinning room, performing the steam-setting on the bobbins, removing the bobbins from the oven and then carrying the heat-treated bobbins to the winding machine where they are fitted on each of the spindles of the winding machine.

In the above procedure, the process of removing the bobbins from the spinning machine and that of fitting the bobbins on the winding machine are each automated. However, the steam-setting process which is between the above two automated processes is not automated an requires associated transporting work. That is, a batch of bobbins in a specified number is carried to the oven for steam-setting. After the steam-setting, the processed bobbins are transported to the winding machine.

In other words, the provision of the steam-setting process for heat-treating the bobbins at a location between the spinning machine and the winding machine requires a series of additional processes as follows.

(1) a process of winding the spun yarn on the bobbin as it is produced by the spinning machine;
(2) a process of putting a specified number of bobbins in a case and transporting the case to the oven;
(3) a process of transporting the bobbins contained in the case to the steam-setting equipment;
(4) a process of removing steam-set bobbins from the steam-setting equipment; and
(5) a process of fitting the steam-set bobbins on the winding machine.

The processes of removing the bobbins from the spinning machine and fitting them on the winding machine are automated relatively easily. The steam-setting process, however, is independent of other processes and this is a major obstacle to making these processes an automated continuous series of processings. The fact that the bobbins are not easy to handle and that the time required for the steam-setting is different from other processing times has also contributed to preventing this process from being a part of the automated series of processings.

In the heat treatment of the bobbins, the time and temperature required for the evacuation process vary depending on the kind of yarn wound on the bobbins, such as whether the yarn is made of wool, cotton or mixed stuff with synthetic fiber.

There is a trend in recent years that the number of bobbins produced per unit of time has been increasing as the spinning machine is being uprated for higher speed. However, with the above-mentioned batch processing method for steam-setting, the entire series of processings is made complicated and difficult to be fully automated.

Although some continuous heat treatment apparatus have been considered in the past, they are large in size, requiring a large installation space, and it has been difficult to install a heat treatment apparatus with a sufficient processing capacity between the spinning machine and the winding machine.

SUMMARY OF THE INVENTION

The present invention has been accomplished to overcome the drawback that, in the conventional heat treatment process for bobbins of yarn, the steam-setting process is independent of other processes and is difficult to be integrated into an automated series of processings. The object of the invention is to provide a method of and apparatus for heat-treating bobbins of yarn which does not require a special installation space; in which a plurality of bobbins produced by the spinning machine is steam-set at one time on a conveyor line; and in which the heat-treated bobbins are transferred to the winding machine or any other desired location.

To achieve the object, the method of the invention consists in: providing a heat treatment bath for steam-setting on a conveyor line which connects the spinning machine and the winding machine together; feeding bobbins of yarn into a bath from one end; closing the bath when a specified number of bobbins is loaded; performing a series of heat treatments such as evacuation, steam-heating, heating at an elevated temperature for a specified duration, reevacuation, and vacuum breaking; and opening the bath and discharging the heat-treated bobbins.

Namely, the bobbins produced by the spinning machine in a specified period of time are collected at one location on the conveyor line between the spinning machine and the winding machine and, after being loaded in the heat treatment bath, they are subjected to the steam-heating process to remove the twisting torque of the yarn.

The operation timing coordination between the spinning machine and the winding machine is made so that the heat treatment bath on the conveyor line between these two machines can perform the steam-heating of the bobbins.

To implement the above heat treatment method, the invention provides a bobbin heat-treating apparatus in which a heat treatment bath is installed on a conveyor line which carries to the winding process the bobbins of finished yarn produced in the spinning process; in which the bobbins are loaded into a bath as they are mounted on peg stands for heat treatment; and in which the heat-treated bobbins are discharged from the bath and transferred to the winding process.

The bobbins fed from the spinning machine are mounted upright on the peg stands and supplied to the heat treatment bath while being guided by a guide surface. The bobbins that were steam-heated are then unloaded, guided by the guide surface.

For the purpose of transferring the bobbins, guide rails that support both sides of the lower ends of the peg stands may be used. The guide rails permit the bobbins to be continuously transferred in line while being supported upright on the peg stands.

The heat treatment bath can accommodate the bobbins in orderly arranged conditions in a number corresponding to the capacity of the spinning machine. Two or more rows of the bobbins on the peg stands are loaded into the bath where they all are heated by steam simultaneously.

Means to feed the bobbins into the bath may be realized by a device which supplies two or more lines of bobbins at one time or one which switches between the empty receiver lines in supplying the bobbins.

It is also possible to provide a plurality of baths that accommodates and heat-treats a specified number of bobbins whereby, while the bobbins are being supplied into and discharged from one of the baths, the bobbins contained in other baths undergo the heat treatment.

DESCRIPTION OF THE PREFERRED EMBODIMENTS

Figure 1:
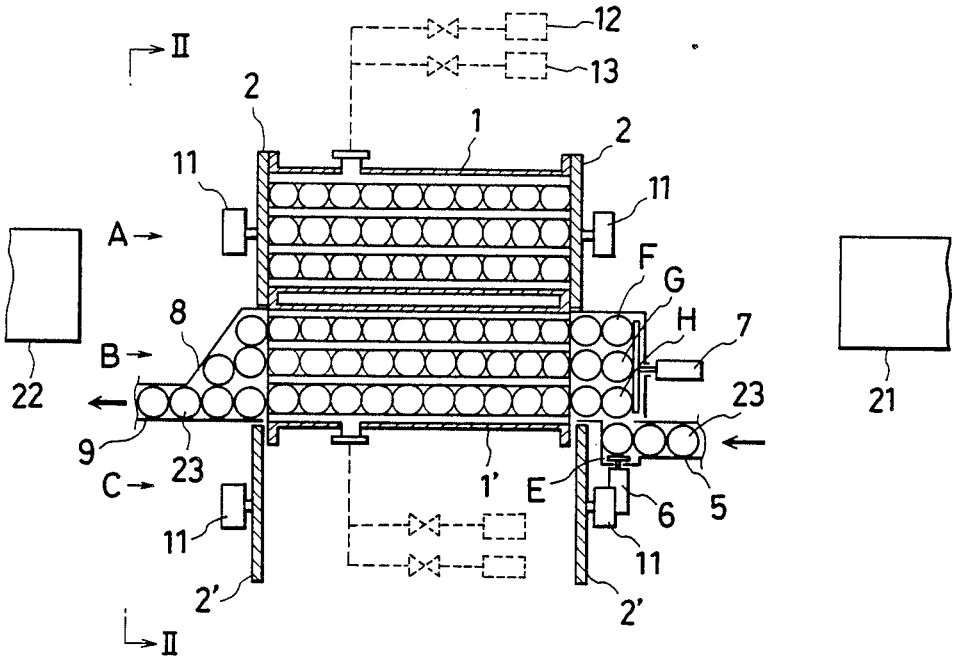
FIGS. 1 through 3 show a first embodiment of the invention, FIG. 1 being a plan cross-section, showing in brief the structure of the heat treatment apparatus for bobbins of yarn, FIG. 2 being a side view as seen from the arrow II—II of FIG. 1, FIG. 3 being a cross-section showing the bobbins mounted on the peg stands supported by a guide rail.

Now, the present invention will be described in greater detail in conjunction with the preferred embodiments illustrated in the drawings.

First Embodiment

Figure 2:
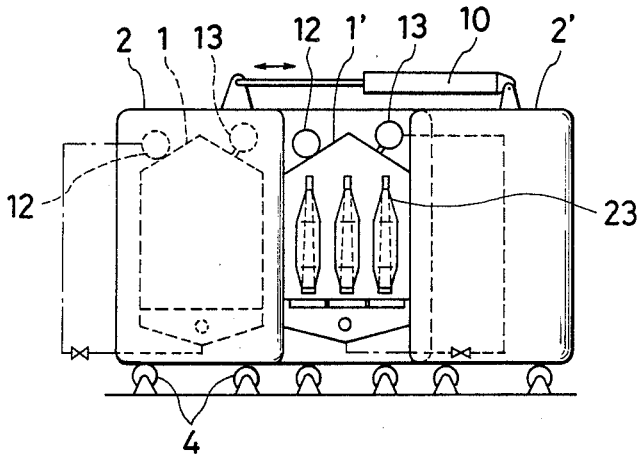

The heat treatment apparatus, as the first embodiment of the invention, consists of a plurality of, in this case two, heat treatment baths 1 and 1' parallelly arranged and connected together which are mounted on rollers 4, as shown in FIG. 2, so that they can be moved at the same time.

Figure 3:
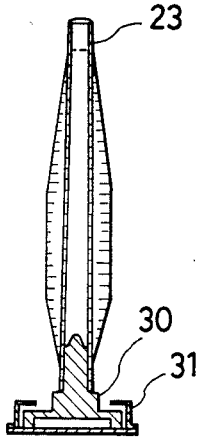

In FIG. 1, two heat treatment baths 1 and 1' connected together are located between a feed conveyor 5 and a discharge conveyor 9 on a conveyor line which transfers the finished yarn on bobbins 23 produced in the spinning process from the spinning machine 21 to the winding machine 22. The bobbins 23 of yarn which are mounted on the peg stands 30 as shown in FIG. 3 are loaded into the heat treatment baths 1 and 1'. The bobbins 23 of finished yarn in one bath are subjected to a series of heat treatments while the other bath is being evacuated or loaded with bobbins.

Now, the operation of the heat treatment equipment will be explained. Suppose that the two heat treatment baths 1 and 1' are positioned as indicated by the arrows A and B of FIG. 1. The bath 1 at the position A is performing a steam-setting operation according to a program. In the bath 1' at the position B, the bobbins 23 of yarn that have undergone the steam-setting operation are pushed out three at a time in parallel by a loading cylinder 7 on the side of the feed conveyor 5 and are pushed out from a discharge chute 8 onto the discharge conveyor 9.

When the steamed bobbins 23 are all pushed out of the heat treatment bath 1', the loading cylinder 7 on the inlet side is stopped. Now, the bath 1' is filled with unprocessed bobbins 23.

When the steam-setting operation is completed in the bath 1 at the position A, the two baths 1 and 1' are driven at the same time by a cylinder 10 shown in FIG. 2 to the positions indicated by B and C respectively.

As to the bath 1 that has come to the position B, the loading cylinder 7 on the inlet side feeds new bobbins 23 and thereby pushes out the steamed bobbins 23 from the discharge chute 8 onto the discharge conveyor 9 as in the case of the bath 1', until the bath 1 is fully loaded with new bobbins 23.

Next, the heat treatment bath 1' transferred to the position C has its door 2' closed by the cylinder 11 and undergoes a series of steam-setting operations including evacuation, steam-heating, leaving for a certain period, and vacuum breaking.

Now, an explanation will be entered into how the bobbins 23 of yarn are handled. Bobbins 23 which have been rolled with finished yarn in the spinning process to their capacity are fed from the spinning machine to the heat treatment baths 1 and 1'. Bobbins 23 which have been carried as mounted on the peg stands 30 to the position shown in FIG. 1 are pushed by a pusher cylinder 6 and change their directions. When they come to the positions F, G and H, the loading cylinder 7 pushes the three bobbins into the heat treatment bath 1' (or 1).

This process is repeated until the bath 1' (or 1) is full of bobbins 23 of finished yarn mounted on the peg stands 30. The bath is then moved to the position C (or position A) and has its doors 2' (or 2) closed, after which it is subjected to a series of heat treatment operations such as evacuation, steam-heating, leaving to stand for a certain period of time, reevacuation and vacuum breaking performed by appropriately operating the vacuum pump 12 and steam generator 13 that are connected to the bath 1' (or 1) for heat treatment.

Then, the structure of the heat treatment equipment of this invention will be described. With the spinning machine and the winding machine 22 located close to each other on a conveyor line, the heat treatment equipment of the invention is positioned between them. For this reason, it is required that the area occupied by the heat treatment equipment should be as small as possible.

To simplify the surrounding of the heat treatment baths 1 and 1', the two baths 1 and 1' are made movable at one time, and the vacuum pump 12 and the steam generator 13 are disposed above the baths 1 and 1'.

The number of bobbins 23 to be heat-treated at one time in the baths 1 and 1' is determined according to the number of threads to be spun by the spinning machine 21, yarn thickness and the time required for each bobbin to be wound with yarn to capacity. At any rate, the size of the heat treatment baths 1 and 1' is determined with some margins.

While the above embodiment uses two heat treatment baths 1 and 1', it is possible to increase the capacity of each bath or the number of baths and thereby increase the number of bobbins to be heat-treated at one time or lengthen the time of the heat processing.

The heat treatment cycle time will be such that if the heat treatment time is five to fifteen minutes, the time for loading and evacuating the bobbins 23 is one-half to one fifth the heat treatment time.

In this invention, the heat treatment is carried out alternately bath 1 (or 1') by bath 1' (or 1), and the bath 1' (or 1) which is loaded or unloaded with the bobbins is used as a pool for the heat-treated bobbins 23.

In the case of a heat treatment apparatus that has more than two baths, of which the above embodiment consists, the invention can also be applied effectively by loading and unloading the bobbins 23 to and from one of the baths and at the same time subjecting the bobbins in other baths to a series of heat treatments.

As mentioned above, since in the heat treatment apparatus of this invention the bobbins of finished yarn are subjected to heat treatment as they are mounted on the peg stands, the yarn on the bobbins can be prevented from being smeared or disturbed, thus improving the yield of products.

Also with the heat treatment apparatus of the invention, since two or more heat treatment baths are moved at a time and one of the baths is loaded or unloaded with a plurality of bobbins of yarn while at the same time the bobbins in the remaining baths are subjected to a series of heat treatments, only one set of loading and unloading devices for bobbins is required, reducing the number of components of the equipment. Furthermore, the positioning of the vacuum pump and steam generator for heat treatment on the top of the heat treatment baths has simplified the site about the heat treatment baths and saved the installation space.

By way of example, concrete conditions for the steaming process for the bobbins will be described below.

(1) In the case of bobbins of polyacrylonitrile fiber yarn with count 36 in thickness scale:

(1) A specified number of bobbins of finished yarn is loaded into the heat treatment bath. (At that time the bobbins already steamed are removed from the bath.) This loading takes about three minutes (this is called a bobbin loading and unloading process).

(2) After the bobbins are loaded into the heat treatment bath, the doors of the bath are closed to subject the bobbins to vacuum. The evacuation process reduces the pressure from normal to 720 mmHg in about one minute (evacuation process).

(3) Under the reduced pressure condition, steam is supplied into the bath to heat the bobbins for about one minute. The temperature in the bath rises to approximately 65° C. at which it is kept for about four minutes. In this steaming process the vacuum level of 720 mmHg is somewhat lowered to the extent that the steam is supplied (steaming and heating process and a leaving process).

(4) Then, the bath is further evacuated to the vacuum level of 560 mmHg for one minute (reevacuation process).

(5) Air is introduced into the vacuum bath to raise the pressure to norml in about 30 seconds (vacuum breaking process).

(6) After this, the doors of the heat treatment bath are opened to unload the steam-set bobbins onto the winding process. At the same time, unprocessed bobbins are carried into the bath.

(2) In the case of bobbins of cotton yarn with count 40 in thickness scale:

(1) The heat-treated bobbins are unloaded from the bath and new bobbins are loaded (bobbin loading and unloading process for about three minutes).

(2) As in the previous case, the pressure is reduced to 720 mmHg (evacuation process for about one minute and 30 seconds).

(3) Under the above reduced pressure condition, steam is supplied into the bath to raise the bath temperature to 90° C. at which it is kept for about four minutes (steaming and heating process for about one minute and 30 seconds; and a leaving process for about four minutes).

(4) The pressure in the bath is then further reduced to a level of 560 mmHg (reevacuation process for about one minute).

(5) Air is admitted into the bath to raise the pressure to normal (vacuum breading process for 30 seconds).

(6) The doors of the bath are opened to remove the steam-set bobbins from the bath for transfer to the winding process. At the same time, unprocessed bobbins of cotton yarn are loaded into the bath.

(3) In the case of bobbins of wool yarn with count 48 in thickness scale:

(1) The heat-treated bobbins are unloaded from the bath and new bobbins are loaded (bobbin loading and unloading process for about three minutes).

(2) As in the previous case, the pressure is reduced to 720 mmHg (evacuation process for about one minute and 30 seconds).

(3) Under the above reduced pressure condition, steam is supplied into the bath to raise the bath temperature to 75° C. at which it is kept for about four minutes (steaming and heating process for about one minute and 30 seconds; and leaving process for about six minutes and 30 seconds).

(4) The pressure in the bath is then further reduced to a level of 560 mmHg (reevacuation process for about one minute).

(5) Air is admitted into the bath to raise the pressure to normal (vacuum breaking process for 30 seconds).

(6) The doors of the bath are opened to remove the steam-set bobbins from the bath for transfer to the winding process. At the same time unprocessed bobbins of cotton yarn are loaded into the bath.

As mentioned above, after the bobbins were steam-set according to the yarn quality and conditions, the twist of the yarn was firmly set so that the ends of the yarn were prevented from turning due to twist torque. Thus the yarn ends were correctly directed in the direction of air flow in the automatic thread jointing apparatus in the winding process and the thread jointing was successfully implemented.

Second Embodiment

Figure 4:
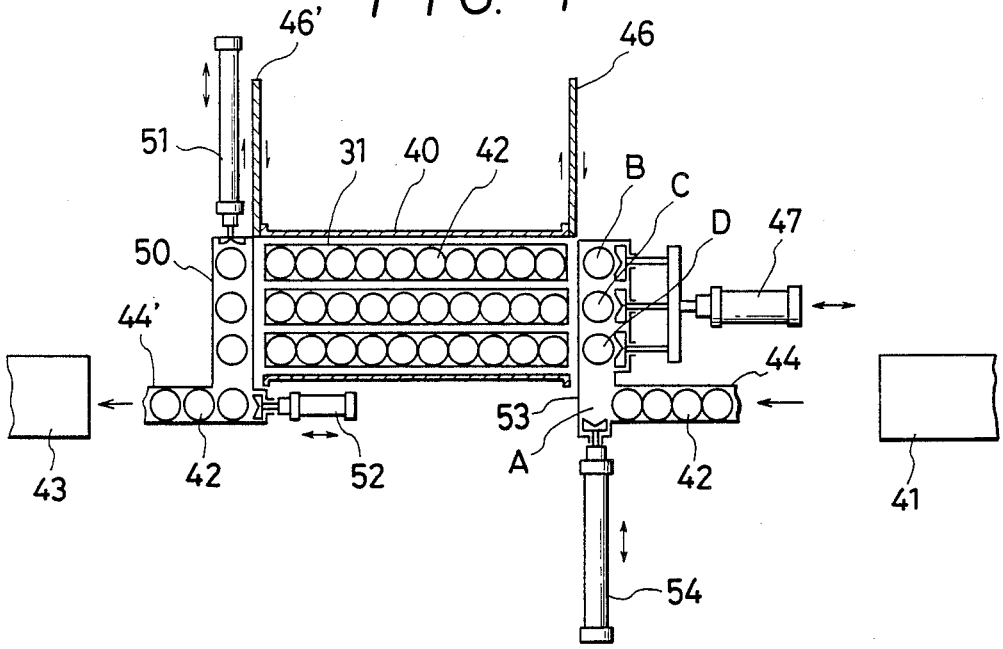
FIGS. 4 and 5 show a second embodiment of the invention, FIG. 4 being a plan cross-section, showing in brief the structure of the heat treatment apparatus, FIG. 5 being a side cross-section of FIG. 4.
Figure 5:
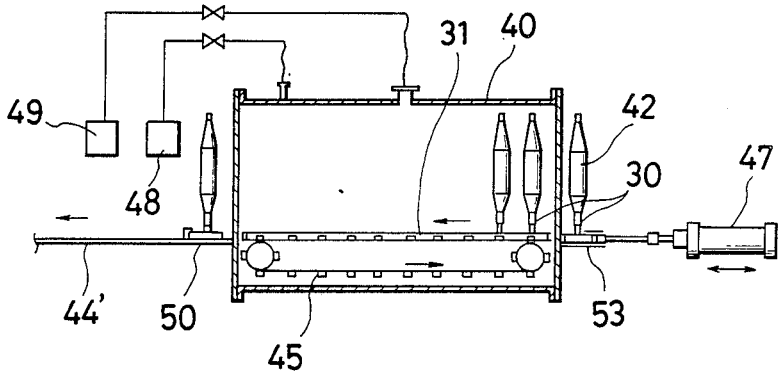

A heat treatment bath 40 making up the heat treatment apparatus is located on conveyor lines 44 and 44' which transfer the bobbins 42 of yarn produced in the spinning process by the spinning machine 41 of FIG. 4 to the winding process by the winding machine 43. Provided in the heat treatment bath 40 are guide rails 31 for holding the peg stands (the same as 30 in FIG. 3) on which the bobbins 42 are mounted. Also a conveyor 45 as shown in FIG. 5 is provided in the bath 40 to move the peg stands 30. The bath 40 is tightly closed by lateral slide doors 46 and 46'.

Next, bobbins 42 which have been rolled with finished yarn to capacity are transferred from the spinning machine 41 to the heat treatment bath 40 by means of the conveyor line 44 that has the guide rails 31 as shown in FIG. 3. The peg stands 30 that have been carried to the position A in FIG. 4 are changed in their directions by a pusher cylinder 54 and come to the positions B, C and D, where they are pushed into the heat treatment bath 40 along the guide rails 31 by a loading cylinder 47.

The above process is repeated until the bath 40 is full of the peg stands 30 on which the bobbins rolled with yarn to capacity are mounted. Then the doors 46 and 46' are closed and the vacuum pump 48 and steam generator 49 connected to the bath 40 are operated to perform a series of heat treatments in the bath 40, beginning with the evacuation process and proceeding to the steaming and heating process, leaving process, reevacuation process, and vacuum breaking process.

When the heat treatment is finished, doors 46 and 46' are opened and the conveyor 45 (FIG. 5) is driven to feed the peg stands 30 one row at a time onto an outlet guide 50. The peg stands 30 fed out of the bath are changed in the direction by a pusher cylinder 51 and then pushed by a pusher cylinder 52 to ride on the conveyor line 44' which carries the peg stands 30 to the winding machine 43.

As the conveyor 45 is driven, new bobbins 42 are loaded into the bath 40 and when the bath 40 is full, the doors 46 and 46' are closed to initiate the next heat treatment cycle.

The number of bobbins 42 to be heat-treated in the bath 40 in one cycle is determined according to the number of threads to be spun by the spinning machine 41, yarn thickness and the time required for each bobbin to be wound with yarn to capacity. At any rate, it is desirable that some margins be allowed for the bath capacity.

Third Embodiment

Figure 6:
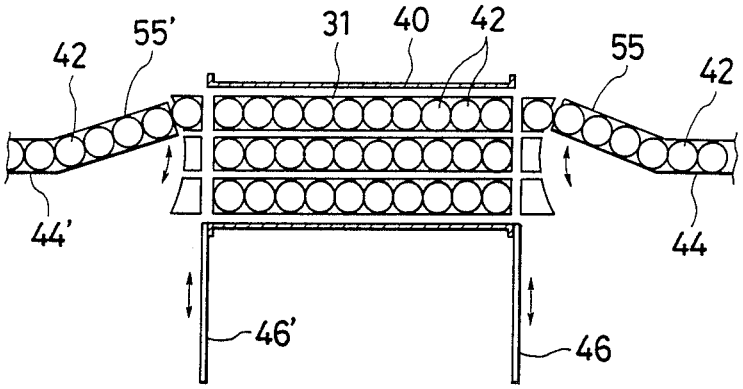
FIGS. 6 and 7 show a third embodiment of the invention, FIG. 6 being a plan cross-section, showing in brief the structure of the heat treatment as in FIG. 4, FIG. 7 being a side cross-section of FIG. 6.
Figure 7:
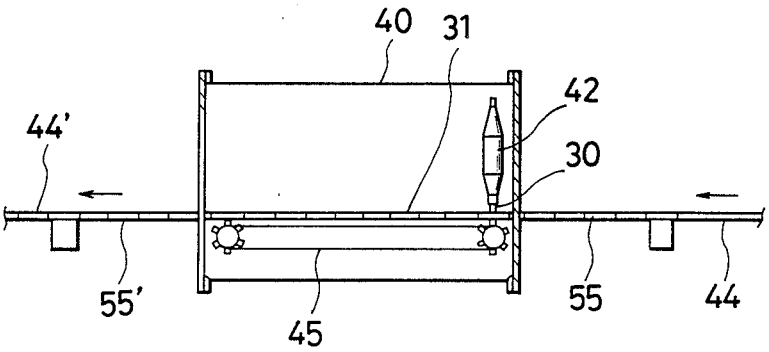

The device in the heat treatment equipment for transferring the bobbins 42 from the conveyor lines 44 an 44' into the heat treatment bath 40 is not limited to the one shown in FIGS. 4 and 5. It may consist of swing aprons 55 and 55' which are installed before and after the heat treatment bath 40. This is shown as a third embodiment in FIGS. 6 and 7. In essence, the only requirement the apparatus has to meet is to temporarily transfer from the conveyor line 44 to the heat treatment bath 40 the bobbins 42 on the peg stands 30 fed from the spinning machine 41 through the conveyor line 44 and, after the heat treatment, to return the heat-treated bobbins 42 onto the conveyor line 44' for feeding them to the winding machine 43.

Fourth Embodiment

Figure 8:
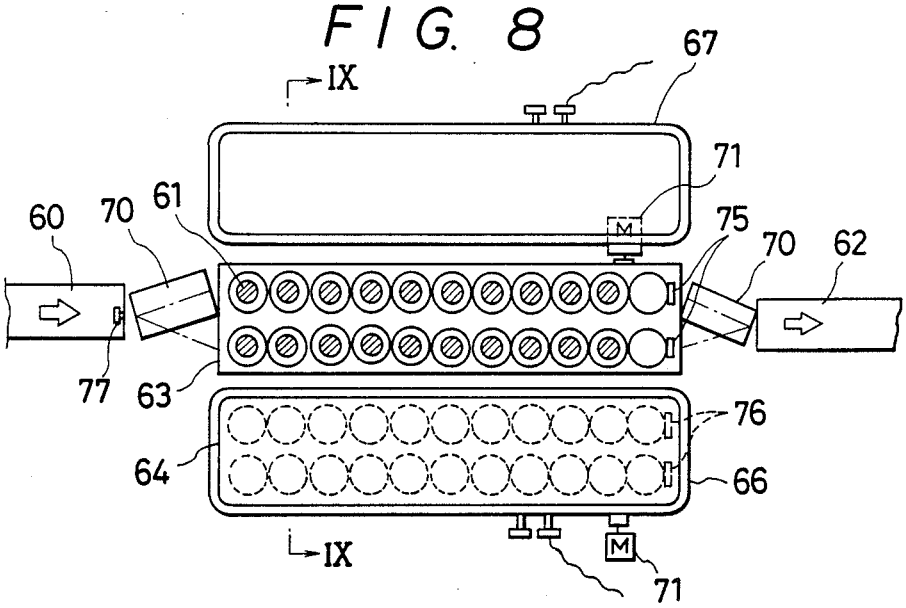
FIGS. 8 and 9 show a fourth embodiment of the invention, FIG. 8 being a plan cross-section, showing in brief the structure of the heat treatment apparatus, FIG. 9 being a cross-section as viewed from the arrow IV—IV of FIG. 8.
Figure 9:
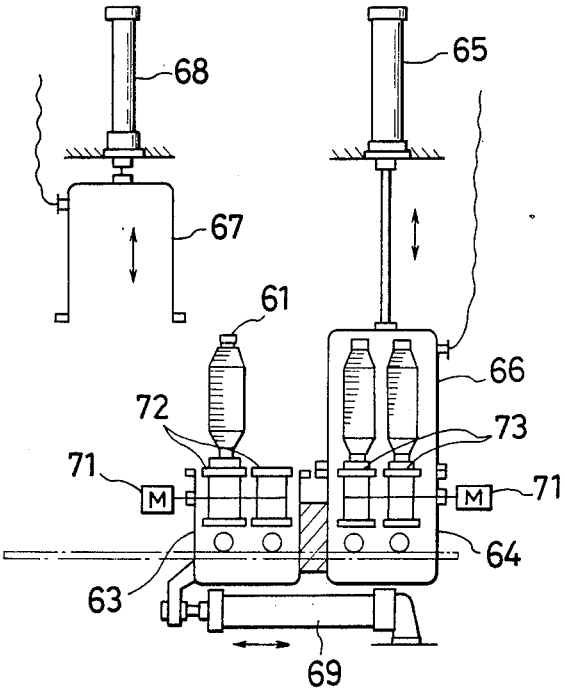

Referring to FIGS. 8 and 9, the reference numeral 60 denotes a conveyor line belt for transferring the bobbins 61 of yarn produced in the spinning process to the heat treatment bath. The numeral 62 is a conveyor belt for sending the heat-treated bobbins 61 to the winding process.

Denoted by 63 and 64 are heat treatment baths which accept the unprocessed bobbins 61 from the belt 60 for heat treatment. In FIGS. 8 and 9, the bath 63 is shown to have accepted the unprocessed bobbins 61 to its capacity. The other bath 64 is shown to be performing heat treatment with its upper opening hermetically closed with a cover 66 which is lowered—when the bath reaches a specified position—by a cylinder 65 over the bobbins 61 to keep the interior of the bath vacuum.

Covers 66, 67 are vertically movable by the action of the cylinders 65 and 68. The covers 66 and 67 are positioned one pitch away horizontally from the bath 63 which is located on the center line of the belt 60, as is seen from FIG. 9.

The reason for the above deviation of the covers is this: The belt 60 of the conveyor line for carrying the bobbins 61 is located at a fixed position, as shown in FIG. 8, so that when the bobbins 61 are to be supplied to the bath 63 or 64, the bath must be aligned with the center of the belt 60 for the bobbins 61 to be fed in.

Since the baths 63 and 64 are required to receive the bobbins 61 from the belt 60 at the position shown in FIG. 9, they are connected together with a gap half the distance between the cylinders 65 and 68 so that the cylinder 69 can move the baths to align the center line of the bath 64 with that of the cylinder 65 or the center line of the bath 63 with that of the cylinder 68.

In more detail, two baths 63 and 64 are parallelly arranged between the conveyor line belts 60 and 62 in such a way that these baths can be moved one pitch at a time by the cylinder 69 to alternately receive or discharge two or more bobbins 61, the number being determined according to the spinning speed or transfer speed of the bobbins 61 of yarn. Further, the covers 66 and 67 alternately used for heat-treating the bobbins 61 can be attached to or detached from the baths 63 and 64 by the vertical cover displacement mechanism or the cylinders 68 and 65.

The loading of bobbins 61 into the baths 63 and 64 from the belt 60 and the unloading thereof from the baths 63 and 64 onto the belt 62 are implemented by a bridge conveyor 70 which can be swung to right and left to switch between the baths. Moreover, the baths 63 and 64 are provided with belts 72 and 73 (FIG. 9) which are driven by a drive motor 71 to bring the bobbins 61 into or out of the baths 63 and 64. Stoppers 75 and 76 are provided on the outlet side of these belts 72 and 73, and a stopper 77 on the outlet side of the belt 60.

Next, a description will be entered into a series of operations of the heat treatment apparatus having the above construction.

At positions similar to those shown in FIG. 9, bobbins 61 are contained in the bath 64 and under the process of heat treatment. In FIG. 9, the center line of the bath 63 is aligned with the center line of the conveyor line belt 60, so that the bath 63 can accept the bobbins 61 of yarn from the belt.

The bobbins 61 carried over here by the belt 60 are fed through the bridge conveyor 70 into the bath 63, where they are successively moved further to the rear by the belt 72 driven by the drive motor 71. When the bath 63 is filled with the bobbins 61 on one side or in one line, it is sensed by the stopper 75.

Then the bridge conveyor 70 is switched to the other side, i.e., to the right-hand side in FIG. 8. The bobbins 61 are likewise moved toward the rear of the bath 63 by the belt 72 and, when the bath 63 is filled with the bobbins 61 on the other side, it is sensed by the stopper 75.

When the bath 63 is filled with the bobbins 61 on both sides and this is sensed by the stopper 75, the stopper 77 on the belt 60 on the inlet side is activated to temporarily stop the supply of bobbins. The cover 66 that evacuated the other bath 64 and performed heat treatment, i.e., steam-setting of the bobbins in the bath 64, is lifted by the cylinder 65. Then the cylinder 69 moves the baths until the center line of the bath 64 is aligned with the center line of the conveyor line belt 60, at which time the drive motor 71 is started to activate the belt 73 to feed the bobbins 61 over the bridge conveyor 70 toward the belt 62 on the discharge side.

At this time, the bath 63 that was moved by the cylinder 69 is now located on the center line of the cylinder 68 and the cover 67. The cover 67 is then lowered by the cylinder 69 to tightly close the bath 63 for performing the heat treatment with steam.

During the heat treatment in the bath 63, the heat-treated bobbins 61 are all discharged from the bath 64. When the stopper 76 senses that the bath 64 is cleared of the bobbins, the stopper on the belt 60 is released to allow the unprocessed bobbins 61 to be supplied into the bath 64. As the stopper 76 senses that the bath 64 becomes full, the cylinder 69 reverses its operation to make the bath 64 enter the heat treatment process. At the same time, the bath 63 proceeds to the bobbin discharge process. The series of the above processes is repeated for continued heat treatment operation.

As explained in the foregoing, during the course of transferring the bobbins of yarn produced by the spinning process to the winding process, the heat treatment apparatus as the fourth embodiment of the invention supplies a plurality of bobbins into two parallel arranged heat treatment baths, one bath at a time and alternately, and performs a specified series of hat treatments on the bobbins one bath at a time followed by the other. Since this process automatically and continuously heat-treats or performs the steam-setting operation on the bobbins as they are transferred from the spinning machine to the winding machine, the bobbin cases and transport carts for carrying the bobbins to the heat treatment apparatus can be obviated. Furthermore, it is no longer necessary to install the steam processing chamber in a separate location, thereby increasing the freedom in designing the arrangement of the spinning mill.

The continuous heat treatment apparatus of the fourth embodiment, in particular, provides many features and advantages. Since two baths are parallel arranged along the conveyor line, no dedicated installation space is required. Also this equipment enables continuous heat treatment of a large number of bobbins within a specified period of time.

We claim:

1. A heat treatment apparatus for bobbins of yarn installed on a conveyor line which connects a spinning machine and a winding machine together, the heat treatment apparatus, comprising: a hermetically enclosed container means being in a hermetically-sealed state for performing a series of heat treatment operations therein such as a vacuum process and a steam-heating process; a heat treatment container being in a non-hermetically-sealed state for allowing a series of upright bobbins of yarn to be supplied into the heat treatment apparatus from one side and discharged from the other side; a vacuum pump means for evacuating the hermetically enclosed container means; and a transfer means for moving the hermetically enclosed container means to the non-hermetically-sealed state, and the heat treatment container to the hermetically-sealed state, each of said bobbins having a non-perforated tube for taking up said yarn.

2. A heat treatment apparatus for bobbins of yarn as set forth in claim 1, wherein the bobbins of yarn are mounted upright on peg stands and, in this condition, supplied into a heat treatment bath of apparatus for heat treatment and are then discharged after heat treatment.

3. A heat treatment apparatus for bobbins of yarn as set forth in claim 1, wherein there are swing type conveyors before and after one of the heat treatment baths at a specified position to transfer upright bobbins on the peg stands.

4. A heat treatment apparatus for bobbins of yarn as set forth in claim 1, further comprising: a conveyor line connecting a spinning machine and a winding machine together; a plurality of heat treatment baths parallel arranged on the conveyor line, the baths being adapted for performing heat treatment on bobbins in hermetically enclosed states; a plurality of covers spaced apart two times the distance between the heat treatment baths, the covers being adapted for enclosing the upper part of the baths; and a device for moving the baths in alternate directions below the covers; whereby the bobbins of yarn which are set upright are supplied into the bath from one side and discharged from the other side.

5. A heat treatment apparatus for bobbins of yarn comprising: a conveyor line connecting a spinning machine and a winding machine together, a plurality of heat treatment baths provided on a path of the conveyor line, the baths being adapted for performing steam-setting operations under hermetically enclosed conditions of said bobbins of yarn; a feed conveyor and a discharge conveyor installed before and after one of the heat treatment baths respectively; a device for moving the baths to connect one of the baths with the feed conveyor and the discharge conveyor at the same time; and steam paths and vacuum paths both connected to the heat treatment baths, each of said bobbins having a non-perforated tube for taking up said yarn.

6. A heat treatment apparatus for bobbins of yarn installed on a conveyor line which connects a spinning machine and a winding machine together, the heat treatment apparatus, comprising: means for releasably bringing the apparatus to hermetic closure and to a hermetically-sealed state; means for feeding a plurality of bobbins of yarn to be treated into the apparatus and for discharging a plurality of treated bobbins of yarn from the apparatus when the apparatus is released from the hermetic closure and from the hermetically-sealed state; a vacuum pump for producing a vacuum condition inside the apparatus when bobbins of yarn to be treated are fed into the apparatus and the apparatus is hermetically closed; means for supplying steam into the apparatus having an internal portion which is maintained in the vacuum condition; and means for moving the apparatus to and from the hermetically-sealed state, each of said bobbins having a non-perforated tube for taking up said yarn.

7. A heat treatment apparatus for bobbins of yarn installed on a conveyor line which connects a spinning machine and a winding machine together, the heat treatment apparatus, comprising: a hermetically enclosed container means being in a hermetically-sealed state for performing a series of heat treatment operations therein such as an evacuation process, leaving process, vacuum breaking process, a vacuum process and a steam-heating process; a heat treatment container means being in a non-hermetically-sealed state for allowing a series of upright bobbins of yarn to be supplied into the heat treatment apparatus from one side and discharged from the other side; and a transfer means for moving the hermetically enclosed container means to the non-hermetically-sealed state, and the heat treatment container means to the hermetically-sealed state, each of said bobbins having a non-perforated tube for taking up said yarn.

* * * * *